US005223663A

United States Patent [19]

Bender-Zanoni et al.

[11] Patent Number: 5,223,663

[45] Date of Patent: Jun. 29, 1993

[54] AUTOMATED AMMUNITION HANDLING SYSTEM

[75] Inventors: Joseph F. Bender-Zanoni, Grand Isle; Jeffrey P. Johnson, Richmond; Michael J. Laurin, Burlington; Richard F. Leopold, South Burlington, all of Vt.

[73] Assignee: General Electric Co., Burlington, Vt.

[21] Appl. No.: 814,988

[22] Filed: Dec. 23, 1991

[51] Int. Cl.[5] ..... F41A 9/38

[52] U.S. Cl. ..... 89/46; 89/47

[58] Field of Search ..... 89/36.08, 36.13, 45, 89/46, 47

[56] References Cited

U.S. PATENT DOCUMENTS

| | | | |
|---|---|---|---|
| 380,688 | 4/1888 | Murray | 89/46 |
| 470,285 | 3/1892 | Canet | 89/46 |
| 4,318,331 | 3/1982 | Echtler et al. | 89/46 |
| 4,617,852 | 10/1986 | Allais et al. | 89/36.13 |
| 4,632,011 | 12/1986 | Metz et al. | 89/36.13 |
| 4,640,181 | 2/1987 | Schiele et al. | 89/46 |
| 4,677,894 | 7/1987 | Pongratz et al. | 89/45 |
| 4,690,031 | 9/1987 | Metz et al. | 89/36.13 |
| 4,823,676 | 4/1989 | Wiethoff et al. | 89/46 |
| 4,838,144 | 6/1989 | Bierwirth et al. | 89/46 |
| 4,898,071 | 2/1990 | Borgwarth | 89/45 |
| 4,947,728 | 8/1990 | Muhlhausen et al. | 89/46 |
| 4,961,367 | 10/1990 | Lindberg | 89/33.04 |

FOREIGN PATENT DOCUMENTS

| | | | |
|---|---|---|---|
| 3208169 | 9/1983 | Fed. Rep. of Germany | 89/46 |

*Primary Examiner*—Stephen C. Bentley
*Attorney, Agent, or Firm*—S. A. Young

[57] ABSTRACT

To handle the transfer of ammunition between a turret bustle magazine and hull magazines of a military tank, a carriage is mounted for horizontal movement between a stow position and a transfer position and for vertical movement between an upper position addressing the bustle magazine and lower positions addressing the hull magazines. An ammunition carrier is mounted to the carriage for rotational motion in a vertical plane driven off the vertical carriage motion, such that the carrier swings around the cannon breech protruding into the turret in assuming reversed end-to-end horizontal orientations when presented to the bustle and hull magazines. Extractor assemblies are axially reciprocated within a carrier tube by a stroke multiplier mechanism to engage and release the base rim of projectile and propellant modules pursuant to transferring modules between the carrier and the hull magazines. Projectile and propellant modules are united while the carrier tube is presented to the bustle magazine.

26 Claims, 9 Drawing Sheets

AUTOMATED AMMUNITION HANDLING SYSTEM

This invention was made with government support under Contract DAAA 22-89-C-0144 awarded by the U.S. army. The government has certain rights in this invention.

The present invention relates to armament systems and particularly to a system for automating the handling of large caliber ammunition for turret-mounted cannons carried by armored vehicles, such as tanks.

BACKGROUND OF THE INVENTION

Considerable efforts by armament manufacturers throughout the world have been devoted to developing automated equipment for handling ammunition for mobile gun systems. This is particularly so in the case of large caliber cannons carried by armored vehicles, such as tanks and self-propelled howitzers. Presently the tasks of withdrawing rounds from magazine storage and loading them into the breech of a tank cannon are almost universally performed manually. A gunloader is thus an essential member of military tank crew.

Modern tank designs are calling for increased ammunition storage capacity to enhance fighting capacity without increasing rearming frequency. Thus, ammunition magazines are being located in the turret bustle, as well as the tank hull. Also, some types of large caliber tank ammunition are comprised of separate modules, a projectile and a propellant unit, which are handled and stored separately and then united preparatory to being fired off by the tank cannon. These factors dramatically increase the manual effort required of a gun loader in handling relatively heavy and bulky ammunition modules pursuant to transferring them between variously situated ammunition storage magazines preparatory to loading the tank cannon. To accommodate these activities, considerable space must be allotted to the gun loader within the tank turret and turret basket. Adequate headroom should be provided so the gunloader can work standing up. Unfortunately, this increases the vertical profile of the tank and thus its target size. The turret must therefore be heavily armored to maximize tank and crew survivability against enemy fire. Of course, heavy armor plating adds tremendously to the weight of a tank, which then calls for a larger engine and drive train.

The factors of high profile and the consequences thereof, the elimination of a gun loader and the consequent space savings, and the prospect of higher firing rates have been the primary motivations for mechanizing the handling of tank ammunition. Of the numerous automated ammunition handling systems seen in the prior art, most are highly complex, extraordinarily space-consuming, difficult to maintain and susceptible to frequent malfunction.

SUMMARY OF THE INVENTION

It is accordingly an objective of the present invention to mechanize the handling of large caliber ammunition between storage magazines in an automated manner utilizing an extremely small space envelope with the limited space available within the gun turret and turret basket of a military tank. More particularly, the automatic handling system of the present invention operates to transfer ammunition between an upper, ready magazine in the turret bustle and one or more lower non-ready magazines in the tank hull. To this end, the automated ammunition handling system includes a carriage mounted by upper and lower trolleys for vertical movement between an upper position addressing the ready magazine and lower positions addressing the non-ready magazines. The trolleys, in turn are mounted for horizontal movement between a stow position aside from the breech of the tank cannon and a magazine transfer position. The carriage mounts a carrier for controlled rotational motion in a vertical plane in coordination with carriage vertical motion. The carrier is equipped with extractor assemblies which are axially reciprocated within a carrier tube by a stroke multiplier cable mechanism to engage a base rim of an ammunition module pursuant to transferring modules between the carrier tube and the non-ready magazine. To transfer an ammunition module contained in the carrier tube from a non-ready magazine to the ready magazine, the carrier is driven upwardly and, in the process, the carrier is driven through an angle of substantially 180° to reverse the end-to-end orientation of the carrier tube. This rotational motion of the carrier enables it to swing around the cannon breech protruding into the turret and also presents the ammunition module in the carrier tube to the ready magazine base end first either for transfer into the ready magazine or for mating with a complementing ammunition module inserted into the carrier tube from the ready magazine. The united modules then constitute a live ammunition round which is drawn into the ready magazine for storage pending retrieval and loading into the cannon breech. The motions of the carriage and carrier are reversed during the transfer of ammunition modules from the ready to the non-ready magazine. When the carriage is relegated to the stow position, the carrier is positioned in an out-of-the-way vertical orientation.

The invention accordingly comprises the features of construction, combination of elements and arrangement of parts, all as detailed hereinafter, and the scope of the invention will be indicated in the claims.

For a full understanding of the nature and objects of the present invention, reference may be had to the following Detailed Description taken in conjunction with the accompanying drawings in which.

Figure 3:
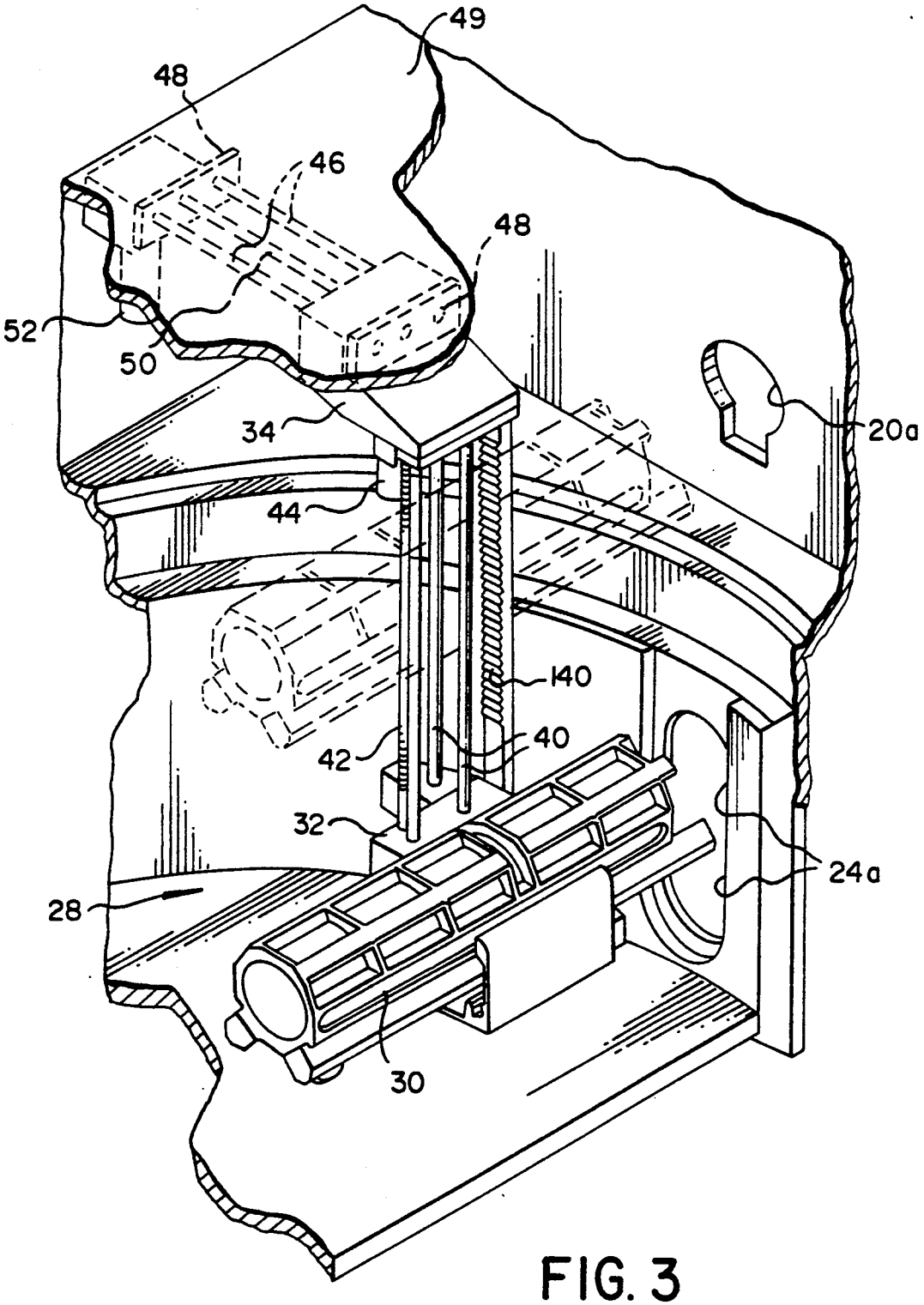
FIG. 3 is a perspective view of the ammunition handling system illustrated in its ammunition transfer positions with respect to the magazines of FIGS. 1 and 2.
Figure 4:
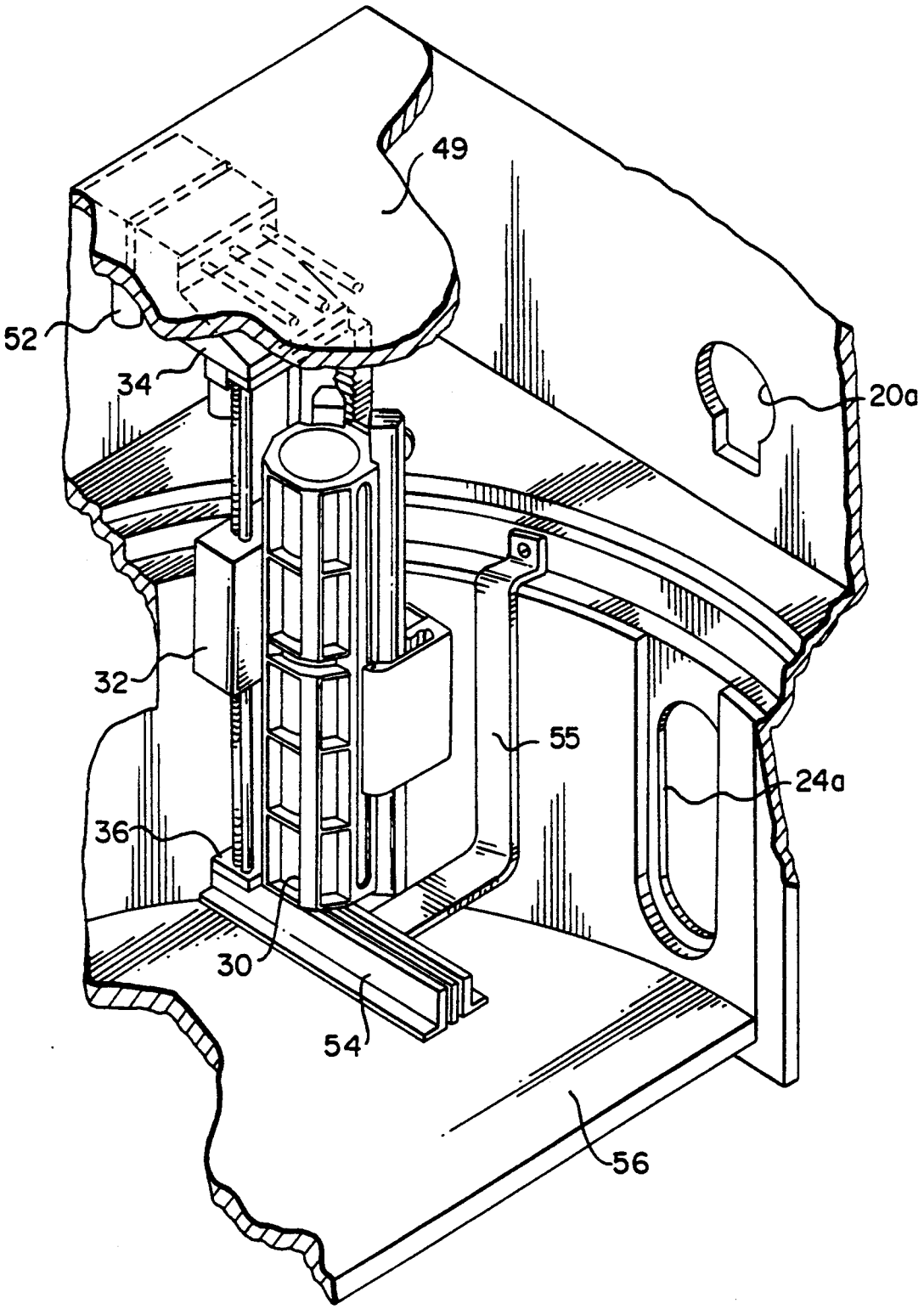
FIG. 4 is a perspective view of the ammunition handling system in its stow position.
Figure 7:
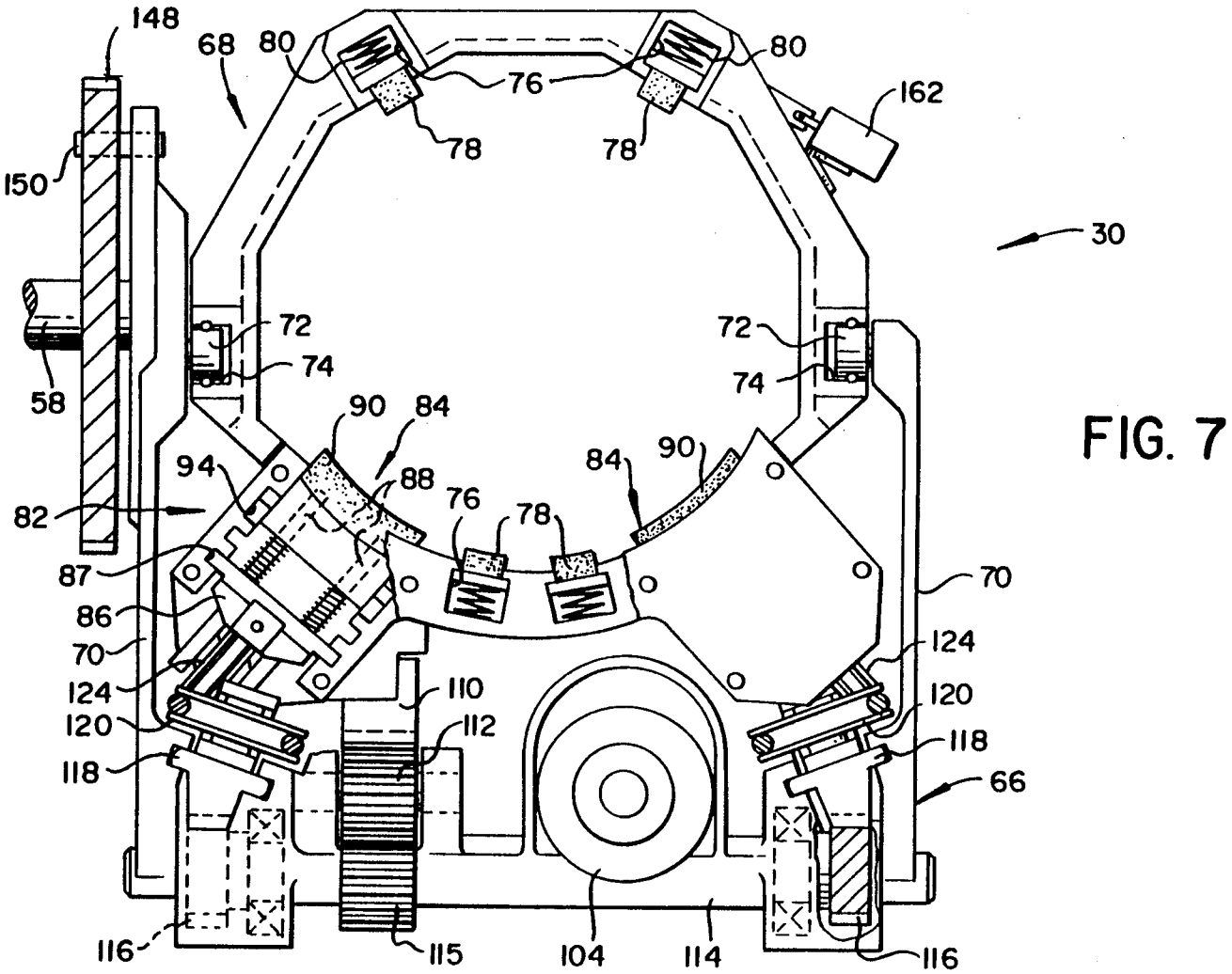
FIG. 7 is an end view, of the ammunition carrier seen in FIG. 3.
Figure 11:
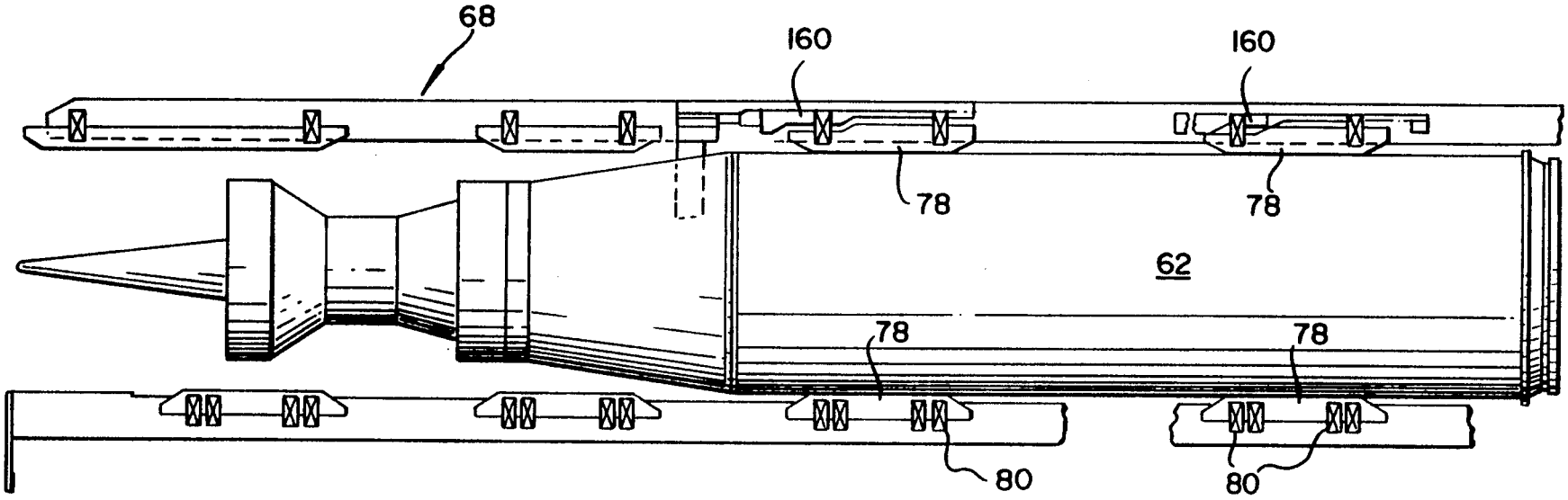
Figure 12:
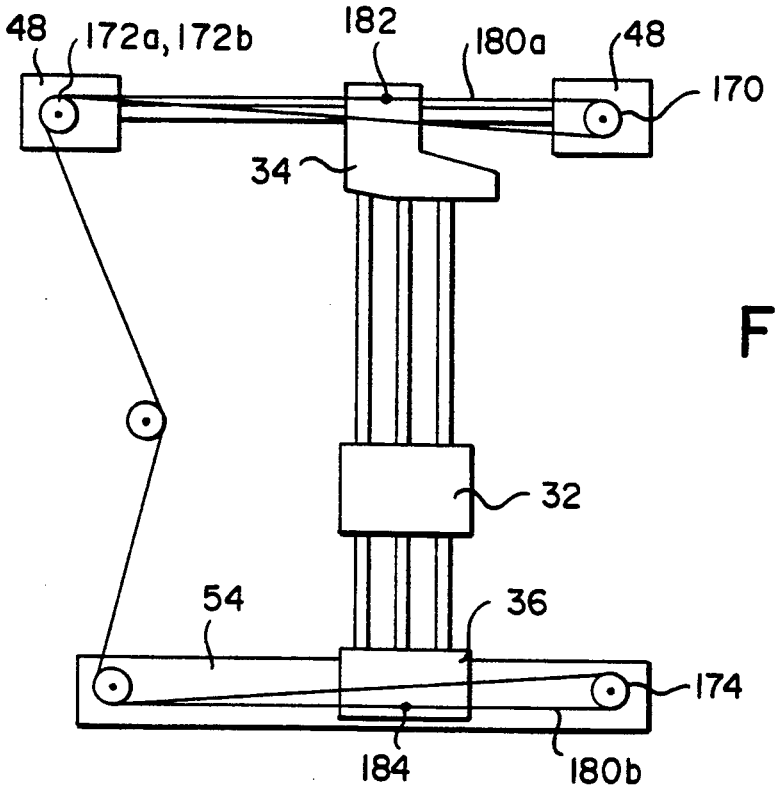
Figure 13:
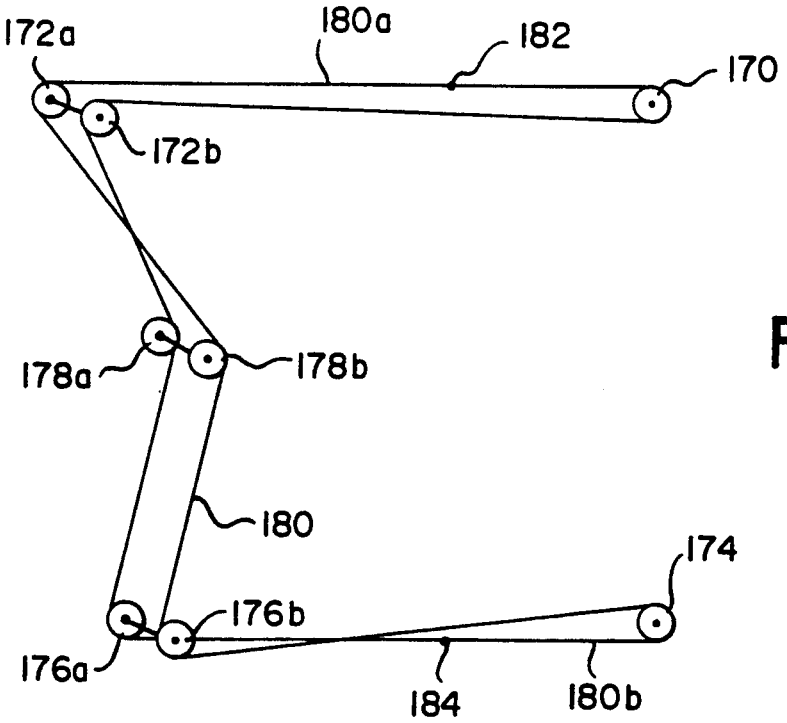

FIG. 11 is an axially sectional view of the carrier tube component of the ammunition carrier seen in FIGS. 3 and 7; and FIG. 12 and 13 are schematic illustrations of a pantograph mechanism for synchronizing the motion of the lower trolley to the driven motion of the upper trolley seen in FIGS. 3 and 4.

Corresponding reference numerals refer to like parts throughout the several views of the drawings.

DETAILED DESCRIPTION

Figure 1:
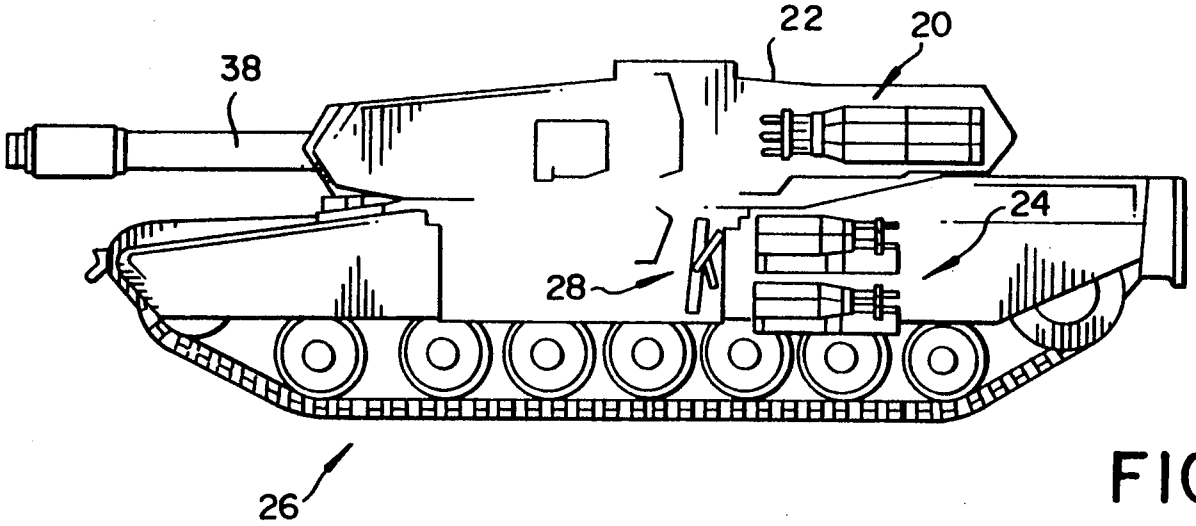
FIG. 1 is a side view of a military tank equipped with the automated ammunition handling system of the present invention.
Figure 2:
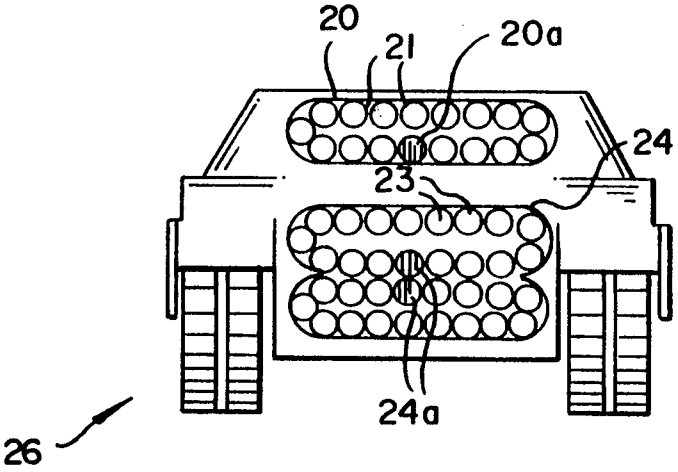
FIG. 2 is an end view of the tank of FIG. 1, illustrating the locations of the various ammunition magazines served by the handling system of the present invention.

The automated ammunition handling system of the present invention, in its embodiment hereinafter illustrated, is applied to transfer ammunition between a ready magazine 20 located in the bustle of a gun turret 22 and non-ready magazines 24 located in the hull of a large battle tank 26 seen in FIG. 1. As seen in FIG. 2, ammunition in the upper ready magazine is stored in carriers 21 of a carrousel conveyor which operates to index its carriers into registry with a transfer port 20*a*. Ammunition in the lower, non-ready magazine is stored in carriers 23 of a pair of stacked carrousel conveyors operating to index their carrier 23 into registry with respective transfer ports 24*a*. The automated ammunition handling system of the present invention, generally indicated at 28 in FIGS. 1 and 3, includes an ammunition carrier 30 which is mounted by a carriage 32 for vertical movement between lower positions addressing either one of the hull magazine ports 24*a* and an elevated position, illustrated in phantom, addressing with bustle magazine port 20*a*. Carriage 32 is, in turn, mounted by an upper trolley 34 and a lower trolley 36 for horizontal movement between an ammunition transfer position vertically aligned with the magazine ports and a stow position illustrated in FIG. 4, clearing the way for recoil of tank cannon 38 (FIG. 1).

More specifically, carriage 32 is slidingly mounted by a plurality of vertical columns 40 affixed at their upper ends to a trolley 34 and at their lower ends to a trolley 36. A vertical ballscrew 42, journalled by the trolleys, engages a ballnut (not shown) incorporated in carriage 32 and is driven by a motor 44 to propel the carriage between its upper and lower vertical positions seen in FIG. 3. Upper trolley 34 is slidingly mounted by rods 46 extending between a pair of headers 48 affixed to the turret roof 49. These headers are preferably structurally robust so as to support substantially the entire weight of ammunition handling system 28. A ballscrew 50, journalled by the headers, engages a ballnut (not shown) incorporated in upper trolley 34 and is driven by a motor 52 to propel carriage 32 into and out of its stow position of FIG. 4. Lower trolley 36 is supported and guided for horizontal motion by a track 54 mounted to the turret by a bracket 55, thus relieving turret basket 56 of any handling system loading.

Figure 5:
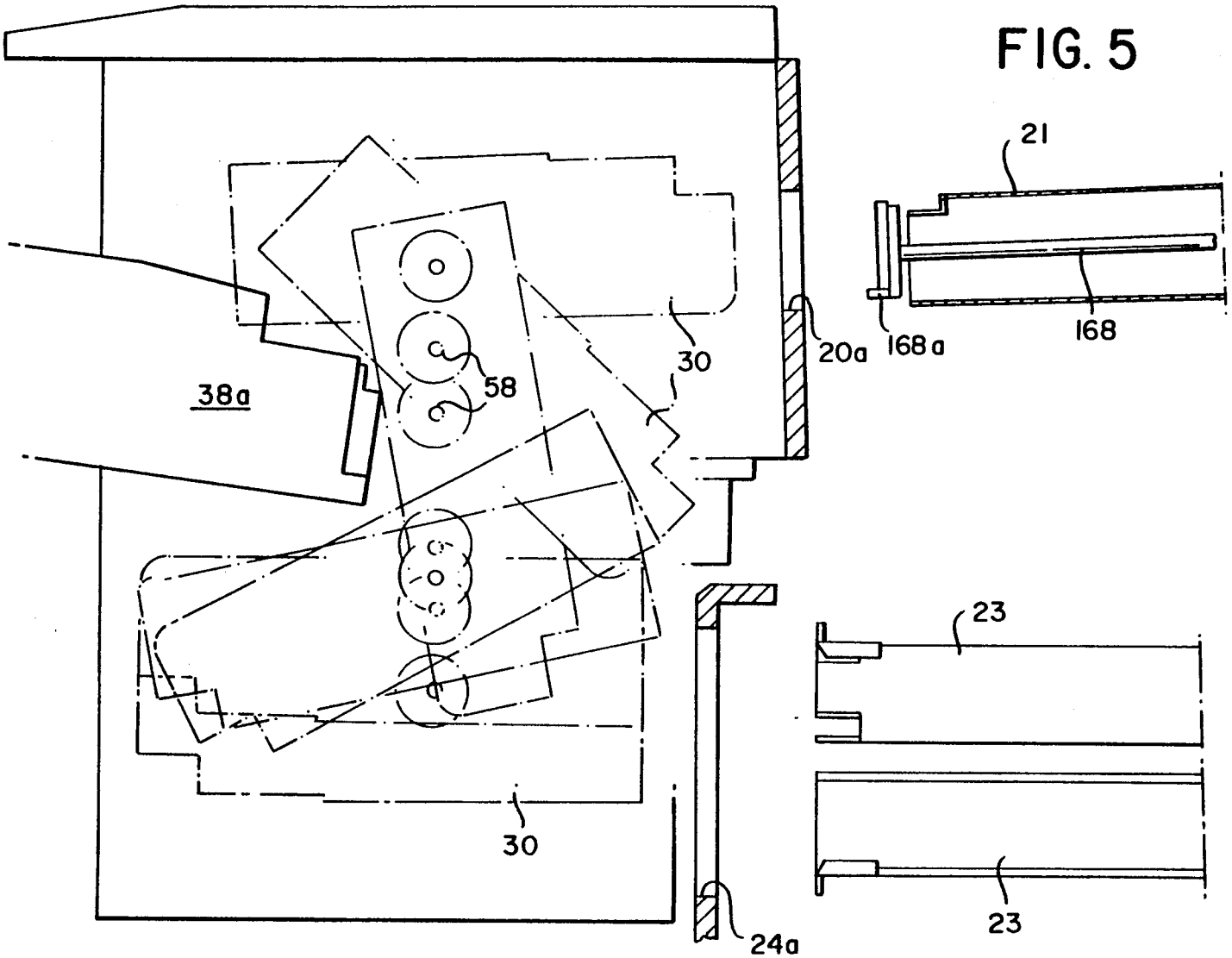
FIG. 5 is a side view illustrating the motion of an ammunition carrier of the system during vertical transfer movement between magazines.

As illustrated in FIG. 5 and detailed below in connection with FIG. 10, vertical motion of carriage 32 is accompanied by rotational motion of carrier 30 to enable the carrier to negotiate around breech 38*a* of the tank cannon as it is translated between a lower position addressing one of magazine ports 24*a* and an elevated position addressing magazine port 20*a*. Thus, while carriage 32 moves vertically between transfer positions aligning carrier 30 with either of the vertically arranged magazine ports 24*a*, the carrier remains horizontally oriented. As the carriage starts upwardly from the upper one of these transfer positions, the carrier begins to rotate about its shaft mounting 58 to the carriage in the counter clockwise direction as seen in FIG. 5. This carrier rotation continues as the carriage progress upwardly, with the result that the carrier swings around cannon breech 38*a* protruding into the turret. It is noted that during the transition out of the turret basket, where clearance is at a minimum, the carrier swings through a vertical orientation. When the carriage achieves its elected transfer position, it is seen that the carrier has been rotated through an angle in excess of 180°, so as to be aligned with a slightly tilted carrier 21 of the ready magazine conveyor that is registered with port 20*a*. In the process, the carrier has been swapped end for end, as has the orientation of an ammunition round contained therein. Downward motion of the carriage is accompanied by reverse rotational motion of the carrier to bring it into alignment with one of the magazine ports 24*a*. As seen in FIG. 4, the carriage is stopped at a intermediate vertical position when the carrier is in a vertical orientation, at which point the carriage is moved horizontally aside by motor 52 into its stow position.

Figure 6:
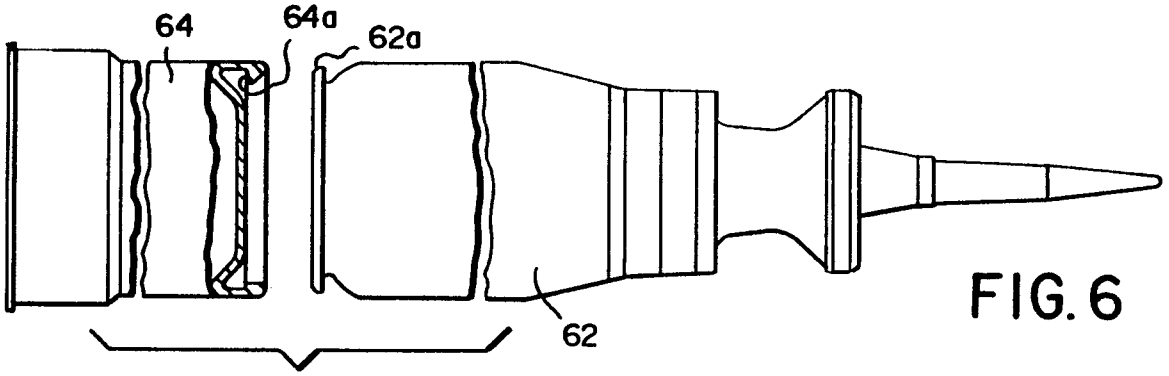
FIG. 6 is a side view, partially broken away, of a pair of complementing ammunition modules handled by the system of FIG. 3.

FIG. 6 illustrates one type of ammunition accommodated by the ammunition handling system of the present invention. This ammunition type consists of two separate modules, a projectile 62 and propellant unit 64 which are stored and handled separately. The projectile base is provided with a radially protruding annular rim 62*a* which is captured under a forward resilient lip 64*a* of the propellant unit to unite the two modules into a live ammunition round preparatory to loading into the cannon breech. The propellant unit base is provided with a radially protruding annular rim 64*b* to accommodate automated handling, and projectile rim 62*a* also serves this purpose. The system of the present invention can also handle conventional cartridge ammunition having a casing base rim corresponding to propellant unit rim 64*b*.

Turning to FIG. 7, carrier 30 includes a base, generally indicated at 66, and a tube, generally indicated at 68. The base is rotatably mounted to the carriage via shaft 58, as noted above, and includes laterally spaced, upstanding arms 70 which carry axially distributed linear bearings 72 running in axially extending exterior tracks 74 formed in the tube, such as to mount the tube for fore and aft sliding motion relative to the base. Axially extending channels 76, running in the interior of tube 68, capture axial series of pads 78 biased radially inwardly by compression springs 80 to provide support at four angularly spaced locations for ammunition modules contained therein and to provide low friction running surfaces for the modules as they are pulled into and pushed out of the tube. The resilient backing of these pads enables the tube to accommodate the different diameters of the propellant and projectile modules.

Figure 8:
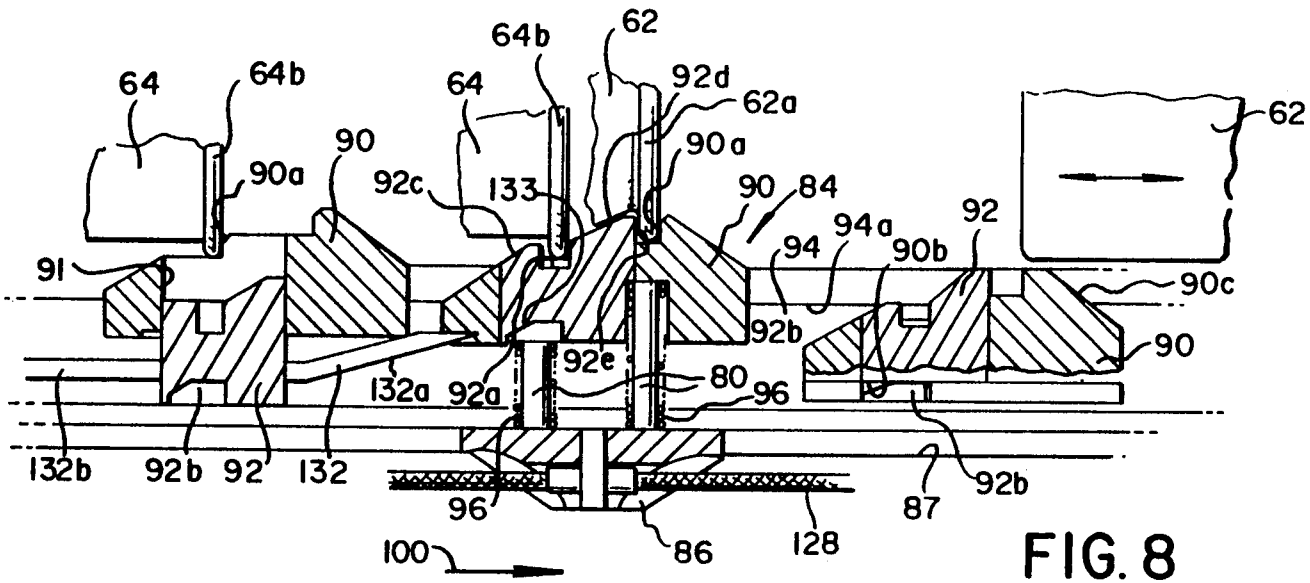
FIG. 8 is a series of illustrations depicting the various positions assumable by ammunition module extractor assemblies incorporated by the carrier of FIG. 7.

Running the full length of the tube are a pair of internal angularly spaced, lower trackway sets, generally indicated at 82, each serving to slidingly mount a separate extractor assembly, generally indicated at 84, for end-to-end axial movement within the tube. Each extractor assembly includes a base 86 running in radially outermost tracks 87 and carrying radially inwardly extending posts 88 serving to separately slidingly mount a pair of extractors 90 and 92, seen in FIG. 8. These extractors run in opposed radially enlarged tracks 94, such that they are free for limited reciprocation on their mounting posts 88 against the bias of compression springs 96 arging them to radially innermost positions against the track inner sides, as seen in FIG. 7. As seen in FIG. 8, extractors 92, which are received in openings 91 in extractors 90, are configured to engage the front side of either rim 62*a* of a projectile or rim 64*b* of a propellant unit (FIG. 6) to enable either ammunition module to be drawn axially into carrier tube 68 in the direction indicated by arrow 100. Extractors 90, on the other hand, are configured to engage the back sides of rims 62*a* and 64*b* to push either ammunition module axially out of the carrier tube in the direction opposite to arrow 100.

Figures 9, 10:
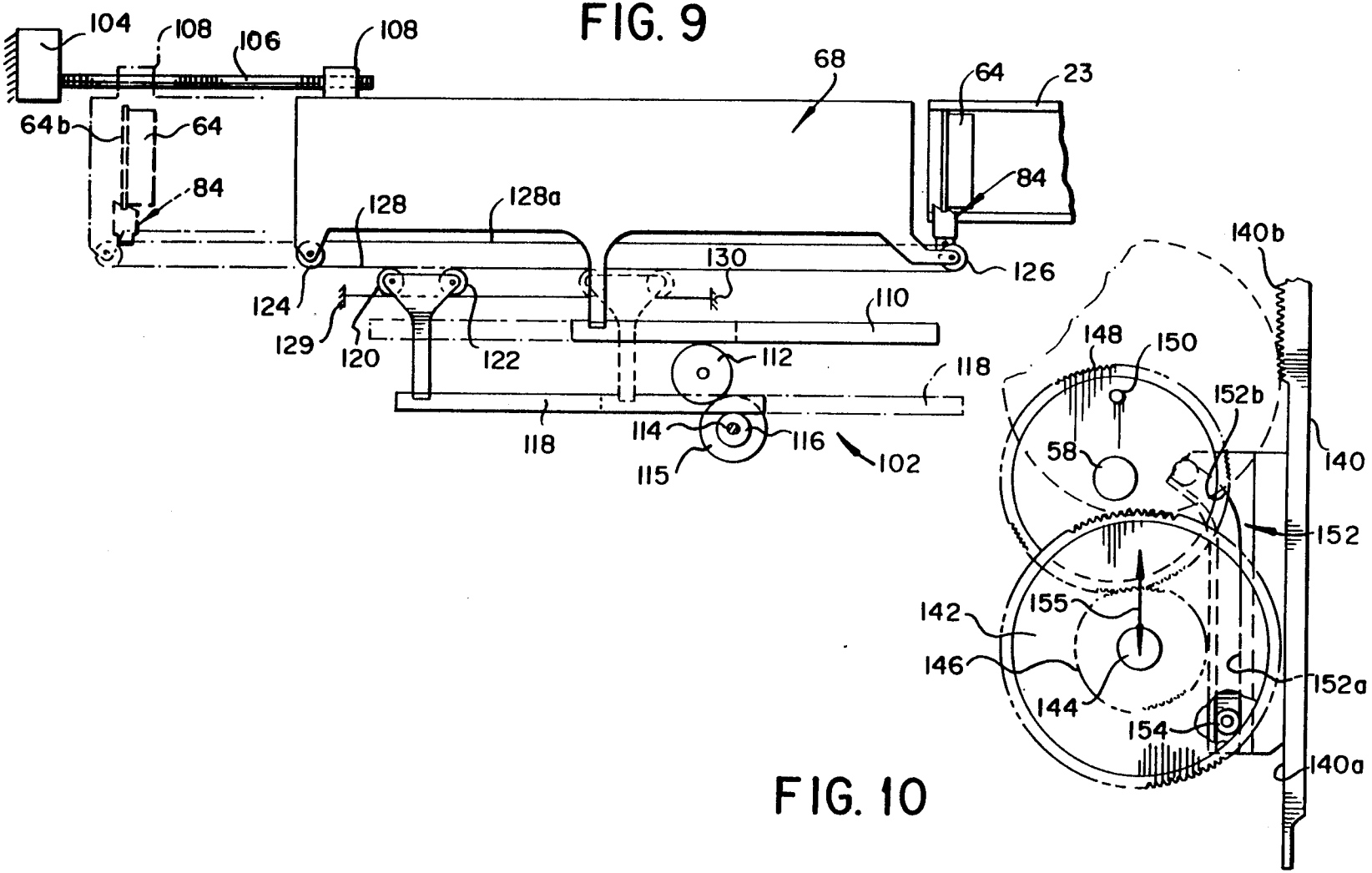
FIG. 9 is a schematic illustration of a stroke multiplyer mechanism for the extractor assemblies of FIGS. 7 and 8.
FIG. 10 is a fragmentary side view of a drive mechanism for producing the rotating carrier motion illustrated in FIG. 5.

To describe the operation of the extractor assemblies 90 in propelling an ammunition module into and out of the carrier tube, reference is made to FIG. 7 and the schematic representation of an extractor assembly stroke multiplier drive mechanism, generally indicated at 102 in FIG. 9. A motor 104, mounted by carrier base 66, drives a ballscrew 106 which engages a ballnut 108 captured by carrier tube 68 to propel the carrier tube through forward and reverse axial strokes relative to the carrier base. Affixed to the carrier tube in parallel relation to its axis is a rack gear 110 which meshes with a pinion gear 112 rotatably mounted by the carrier base. As seen in FIG. 7, this pinion gear drives an axle 114 journalled by the carrier base via a gear 115. A separate pinion gear 116 is affixed to axle 114 adjacent each of its ends in positions to engage rack gears 118 mounted by the carrier base for fore and aft sliding movement parallel to the carrier tube axis. Each rack gear 118 mounts a pair of pulleys 120 and 122 (only pulley 120 seen in FIG. 7). A pair of angularly spaced pulleys 124 are mounted to the aft end of the carrier tube as seen in FIG. 7, and a pair of angularly spaced pulleys 126 are mounted to the forward tube end (only one pulley 126 illustrated in FIG. 9). As seen in FIG. 9, a separate cable 128 is wrapped around each of the two sets of the essentially axially aligned pulleys 120, 122, 124 and 126. One end of each cable is anchored to the carrier base, as indicated at 129, and runs axially forward to wrap around a pulley 120 and then axially rearward to a pulley 124. From the wrap around these pulleys at the rearward end of the carrier tube 68, each cable 128 runs parallel to the tube axis to wrap around a pulley 126 at the forward tube end. From the wrap around this pulley, each cable runs axially rearward to wrap around pulley 122 and then axially forward to its other end anchored to the carrier base, as indicated at 130. The base 86 of each extractor assembly 84 is clamped onto one of the cables 128 such that the extractor assemblies are propelled axially by the motions of the upper or radially inner axial cable runs 128*a* between pulleys 124 and 126.

The multiplier drive mechanism 102 is shown in FIG. 9 in its extended condition with parts illustrated in solid line and in is retracted condition with part illustrated in phantom line. It is assumed that a propellant unit 64 is fully retracted into carrier tube 68 with its base proximate the aft or left end of the tube and its rim 64*b* engaged by extractor assemblies 84. When motor 104 drives ballscrew 106 in the forward direction, carrier tube 68 is driven through a forward axial stroke of length X from its phantom line position to its solid line position. Concurrently, rack gear 110 executes an equal forward stroke by virtue of its connection to the carrier tube, moving from its phantom line to solid line positions. This forward stroke of rack gear 110 drives pinion gear 112 in the clockwise direction, and pinion gears 115, 116 in the counter clockwise direction. Rack gears 118 are thus driven through equal rearward strokes from their illustrated phantom line to solid line positions. The length Y of these rearward strokes is determined by the ratio of gears 112, 115 and 116. Also stroked rearwardly are the pulley sets 120 and 122, as they are tied to rack gears 118.

By virtue of this pulley and cable arrangement, the net effect of these strokings is to propel extractor assemblies 84 from the aft end to the forward end of the carrier tube, and thus to push propellant unit 64 completely out of the carrier tube and into a conveyor carrier 23 of a non-ready magazine 24. This is seen from the fact that, by virtue of the double overhaul or 180° wraps of the cables around pulleys 120 and 124, the forward stroke X of the carrier tube produces a forward motion of the extractor assemblies of a length equal to twice this forward stroke length (2X). This extractor assembly stroke multiplication is factored with stroke multiplication produced by the rearward strokes of rack gears 118. By virtue of the double overhaul or 180° wraps of the cable around pulleys 122 and 126, the resulting forward motion of the extractor assembles 84 is equal to twice the length of the rearward strokes of rack gears 118 (2Y). Thus, the length of the extractor assembly strokes is equal to $2X+2Y$. It will be appreciated that, when motor 104 is driven in the reverse direction, the parts are retracted to their phantom line positions with the same stroke multiplication to draw the extractor assembles back to the aft end of the carrier tube.

It is thus seen that, by virtue of stroke multiplier mechanism 102, a relative short carrier tube stroke X, which is typically quite limited by the available space envelope in a turret basket, produces an extremely long extractor assembly stroke. Moreover, the drive multiplier mechanism is driven by a single motor and is capable of compact packaging within carrier 30. It will be appreciated that, by using single, double and even triple overhaul pulley/cable arrangements and various pinion gear ratios, a wide range of stroke multiplication can be achieved. Also, the pinion gears 112, 115 and 116 may be driving interconnected through a ratio changing gearbox so that the stroke multiplication factor can be selectively changed to accommodate different ammunition handling functions.

As noted above in connection with FIG. 8, each extractor 92 of the extractor assemblies 84 is configured to engage the larger diameter rim 64*b* of a propellant unit 64 and the smaller diameter rim 62*a* of a projectile 62 to draw these ammunition modules into the carrier tube in the direction of arrow 100. Extractors 90 are then configured to engage these rims to push ammunition modules out of the carrier tube. When the extractor assemblies are stroked out in the direction opposite of arrow 100 to the forward end of the carrier tube while in registry with one of the magazine ports 24*a* to extract an ammunition module from the magazine conveyor carrier 23 aligned therewith, the extractors 90 and 92 run against the radially inner sides 94*a* of tracks 94 due to the bias of springs 96. As the sloped leading surfaces 92*c* of the extractors 92 encounter the base rim of the ammunition module in the conveyor tube, they are cammed radially outward. If the ammunition module is a propellant unit 64, which, by design, resides a predetermined distance deeper in a conveyor carrier than does a projectile, the extractors reach the end of their forward strokes with notches 92*a* of depressed extractors 92 in radial registry with propellant case rim 64*b*. Springs 96 can then push the extractors 92 radially inward to capture the propellant unit rim in their notches, as seen in the center illustration of FIG. 8. When the extractor assemblies are driven through a rearward or return stroke, the propellant unit is extracted from the conveyor carrier and drawn into the carrier tube. If a propellant unit is to be inserted into a magazine carrier, the extractor assemblies are driven through a forward stroke. Since extractors 90, in which extractors 92 are nested, are configured with radial edge surfaces 90*a* in flanking relation with rear sides of notches 92*a*, the propellant unit is pushed out of carrier tube 68 by extractors 90 as well as extractors 92.

It will be noted in FIG. 8, that, while the extractors have control of the propellant unit rim, they are depressed somewhat by the weight thereof. As the extractor assemblies approach the end of their forward strokes, track runners 92*b* extending laterally from extractors 92, are sufficiently depressed to encounter cams 132 formed on the bottom surfaces of tracks 94. The leading ends of these cams intercept the sloping leading edge surfaces 133 of track runners 92*b*, and extractors 92 are progressively further depressed by the ramp surfaces 132*a* of the cams. The forward stroke of the extractor assemblies is concluded with track runners 92*b* running against the axially extending outer sides 132*b* of the cams. Thus, as seen in the left illustration of FIG. 8, with extractors 92 held in fully depressed positions by cams 132, their notches 92*a* are disengaged from the propellant unit rim 64*b*. This leaves the edge surfaces 90*a* of extractors 90 in pushing engagement with the propellant unit rim to complete the full insertion of the propellant into a conveyor carrier 23 at the conclusion of a extractor assembly forward stroke.

To extract a projectile 62 residing in a conveyor carrier at a predetermined shallower position than a propellant unit, the extractors 92 are depressed as their sloped surfaces 92*d* engage projectile rim 62*a* during the conclusion of an extractor assembly forward stroke. Since a projectile rim is of a smaller diameter than a propellant unit rim, as seen in FIG. 6, it clears the notches 92*a* in extractors 92, and the forward stroke concludes with the rear edge of a projectile rim 62*a* in virtual engagement with radial surfaces 90*b* of extractors 90. The depressed extractors 92 can then snap back under the bias of their springs to present radial edge surfaces 92*e* in pushing relation with the forward edge of the projectile rim. Thus, as seen in the center illustration of FIG. 8, these extractors edge surfaces 90*b* and 92*e* provide notches in which the projectile rim is captured at the conclusion of an extractor assembly forward stroke. When the extractor assemblies execute a rearward or return stroke, a projectile is extracted from a conveyor tube and drawn into the carrier tube by extractors 92. To insert a projectile into a conveyor tube from the carrier tube, radial surfaces 90*b* of extractors 90 engage the rear side of projectile rim 62*a* to push the projectile out of the carrier tube and into the conveyor tube during a extractor assembly forward stroke. During the concluding portion of this forward stroke, extractors 92 are depressed by cams 132 to relinquish their control on the projectile rim. At the conclusion of the forward stroke, extractors 90 will have inserted the projectile into the conveyor carrier to the proper depth where it is left as the extractor assemblies are retracted by a return stroke.

As described above in conjunction with FIG. 5, carrier 30 is rotated through an angle of substantially 180° as its carriage 32 is raised and lowered on its vertical mounting columns 40 by rotation of ballscrew 42. As seen in FIG. 3, in addition to mounting the ends of the ballscrew and columns, the upper trolley 34 and lower trolley 36 also mount the ends of a vertically oriented rack gear 140, which is utilized to produce the controlled rotational motion of the carrier. Turning to FIG. 10, a circular gear 142 is rotatably mounted on a shaft 144 carried by carriage 32. A pinion gear 146, also journalled on shaft 144, is fixed to gear 142 and meshes with a spur gear 148 journalled on shaft 58 which, as noted above, rotatably mounts carrier 30 to carriage 32. As seen in FIG. 7, this spur gear is fixed to carrier base 66 by a pin 150. Mounted to the lower non-tooth section 140*a* of rack gear 140 is a cam track 152 having a lower straight vertical section 152*a* blending into an upper angular elbow section 152*b*. Running in this cam track is a cam follower 154 which is affixed to a face of gear 142.

Now, while carriage 32 moves vertically (arrow 155) between its two lower positions addressing the non-ready magazine ports, cam follower 154 runs in the vertical section 152*a* of cam track 152. Therefore, gear 142 can not rotate, and thus carrier 30 is locked up in the requisite horizontal orientation to serve non-ready magazines 24. As the carriage is raised above the upper one of the non-ready magazine ports, the cam follower encounters the blend into elbow track section 152*b*, and gear 142 is driven into rotation in the clockwise direction, as is pinion gear 146. This gear drives spur gear 48 in the counter clockwise to begin the counter clockwise rotation of carrier 30 seen in FIG. 5. As the cam follower continues up through the elbow section, gear 142 is gradually accelerated. The angular orientation of the elbow section is coordinated with linear velocity of the carriage vertical motion so as to achieve synchronous meshing of gear 142 with the toothed vertical section 140*b* of rack gear 140, which then takes over in rotating carrier 30 through the remainder of the essentially 180° angle.

While carrier 30 is being rotated with an ammunition module contained therein, the extractor assemblies maintain the axial position of the module to prevent it from falling out of the carrier tube. However, since the module supporting pads 78 are spring-backed, the position of the module centerline relative to the carrier tube axis assumed when the ammunition module was loaded into the carrier tube will shift radially when the carrier and module are flip end-for-end. To prevent this module radial shift, elongated locking bars 160, seen in FIG. 11, are axially reciprocated by a linear actuator 162 (FIG. 7) into and out of wedging engagement with the back sides of those pads 78 diametrically opposed to extractor assemblies 84. These pads are thus pressed radially inward into contact with the cylindrical portion of the module to provide fixed underlying radial support for the ammunition module when it is flipped essentially 180° as the carrier is raised to address the ready magazine. Thus, displacement of the module centerline relative to the carrier tube axis is prevented.

As another feature of the present invention, actuator 162 also reciprocates an axial stop 166 into and out of engagement with the ogive of a projectile 62 residing in carrier tube 68. This feature is utilized when a projectile and a propellant unit are united, as described above in connection with FIG. 6. FIG. 5 illustrates a rammer 168 which reciprocates into and out of the ready magazine conveyor carrier 21 registered with port 20*a*. This rammer is utilized to push a propellant unit out of the conveyor carrier and into the carrier tube. As the forward end of the propellant unit enters the carrier tube from the right as seen in FIG. 11, the extractors are cammed radially outward to depressed positions, shown in the right illustration of FIG. 8, releasing the rim of the projectile residing within the carrier tube. Depression of extractors 90 is achieved by engagement of the propellant unit leading edge with the sloped surfaces 90*c* of extractors 90. Extractors 92 are forced into depressed positions by virtue of the engagements of underlying surfaces 90*d* of extractors 90 against radially inner sides of track runners 92*b*. If depression of extractors 90 produces excessive binding on their mounting posts, separate actuators, positioned in advance of these actuators, may be utilized to depress the extractors in response to propellant unit approach. As the rammer continues to push leftward, the projectile is moved forward a short distance until it is halted by axial stop 166 in its extended position. The rammer can then force the resilient lips 64*a* of the propellant unit to snap over the rim 62*a* of the projectile, thus uniting the two modules to produce a live ammunition round. The rammer is equipped with extractors 168*a* similar to the carrier extractors, which engage the propellant unit rim 64*b* to enable the rammer to pull the united modules out of the carrier tube and into the ready magazine conveyor carrier. The rammer also can extract individual ammunition modules from the carrier tube, which were retrieved from the non-ready magazines. The rammer cams extractors 90, 92 to their depressed positions of FIG. 8 in the manner described above. With suitable carrier modification the rammer could load a live ammunition round into the cannon breech through carrier tube 68, or the forward stroke of extractor assemblies 84 could be used to ram a live round into the breech.

FIGS. 12 and 13 illustrates a cable pantographic arrangement utilized to ensure precise tracking of the lower trolley 36 with the driven upper trolley 34 during horizontal movement of the ammunition handling system between its stow position of FIG. 4 and its ammunition transfer position of FIG. 3. It will be appreciated that the two trolleys must move in synchronism to ensure proper alignment and to avoid binding. Thus, as seen in FIGS. 12 and 13, headers 48 mounting upper trolley 34 for horizontal driven movement between the stow and ammunition transfer positions (FIGS. 3 and 4) carry pulleys, one pulley 170 in the case of the right header and two pulleys 172*a* and 172*b* in the case of the left header. Similarly, guide track 54, which guides and supports lower trolley 36 for movement between the stow and ammunition transfer positions, mounts a single pulley 174 adjacent its right end and a pair of pulleys 176*a* and 176*b* adjacent its left end. Then a pair of pulleys 178*a* and 178*b* are mounted to the turret at a mid-height position between the headers and guide track. An endless cable 180 is then trained around these pulleys in a manner best seen in FIG. 13. Upper trolley 34 is clamped onto the horizontal cable run 180*a* between pulleys 170 and 172*a* as indicated at 182, and lower trolley 36 is clamped onto the horizontal cable run 180*b* between pulleys 174 and 176*a*, as indicated at 184. Note that the cable runs between pulleys 172*a*, 172*b* and pulleys 178*a* and 178*b* cross, in that one run is between pulleys 172*a* and 178*b*, while the other run is between pulleys 172*b* and 178*a*.

It is thus seen that, when the upper trolley 34 is driven leftward toward the stow position, cable run 180*a* is drawn to the left since the upper trolley is clamped thereto at point 182. By virtue of the manner in which cable 180 is trained through the pulley network, cable run 180*b* travels leftward in complete synchronism with cable run 180*a*, and, with lower trolley clamped thereto at point 184, it duplicates the leftward motion of the upper trolley. Rightward driven motion of the upper trolley is duplicated by the lower trolley in the same manner, since the cable runs 180*a* and 180*b* must always move synchronously in the same direction. Thus, precise vertical alignment of the upper and lower trolleys is maintained as the ammunition handling system moves between the stow and ammunition transfer positions. Cable 180 also provide stability when the system is stopped in either position.

It is seen from the foregoing that the objectives set forth above, including those made apparent from the preceding Detailed Description, are efficiently attained, and, since certain changes may be made in the construction set forth without departing from the scope of the invention, it is intended that matters of detail be taken as illustrative and not in a limiting sense.

Having described the invention, what is new and desired to secure by Letters Patent is:

1. An automated handling system for transferring large caliber ammunition modules between a first magazine in the turret bustle and a second magazine in the hull of a military tank, said system comprising, in combination:

A. a carriage mounted for vertical movement between an upper position addressing the first magazine and a lower position addressing the second magazine;

B. an ammunition carrier including 1) a base mounted by said carriage for rotation in a vertical plane, 2) a tube mounted by said base for containing an ammunition module, 3) at least one extractor assembly slidingly mounted within said tube for reciprocation through forward and reverse axial strokes between opposed open ends of said tube, said extractor assembly including at least one extractor for engaging a base rim of an ammunition module residing in said second magazine, whereby to retract an ammunition module residing in the second magazine into said tube during said reverse stroke and to insert an ammunition module from said tube into the second magazine during a forward stroke; and C. means for jointly propelling said carriage in vertical movement and said carrier in rotational motion such that said carrier assumes one end-to-end orientation when said carriage is in said lower position and assumes a reversed end-to-end orientation when said carriage is in said upper position.

2. The automated handling system defined in claim 1, wherein said propelling means includes a vertical oriented ballscrew for driving said carriage in vertical movement and a rotating mechanism for driving said carrier in rotational motion, said rotating mechanism including a stationary rack gear fixed in parallel relation to said ballscrew, a first circular gear journalled by said carriage in position to be driven into rotation by said rack gear in response to vertical movement of said carriage, and a spur gear fixed to said base and driven off said circular gear to impart rotational motion to said carrier.

3. The automated handling system defined in claim 2, wherein said rack gear includes an upper toothed section and a lower non-toothed section, and said rotating mechanism further includes a cam track mounted in fixed relation with said non-toothed section and a cam follower running in said cam track and fixed to said circular gear, said cam track being configured to maintain said carrier in a horizontal orientation during initial upward movement of said carriage from said lower position and then to impart rotational motion to said circular gear leading to synchronous meshing engagement with said toothed section of said rack gear.

4. The automated handling system defined in claim 1, wherein said extractor assembly includes first and second extractors jointly running in an axially elongated trackway formed in said tube and springs separately biasing said first and second extractors to radially inwardly extended positions in said trackway, said first extractor in said extended position engaging the base rim of an ammunition module during said reverse stroke and said second extractor in said extended position engaging the base rim of an ammunition module during said forward stroke.

5. The automated handling system defined in claim 4, wherein said trackway includes a cam positioned to depress said first extractor to a radially outwardly retracted position in non-engaging relation with the ammunition module base rim during the concluding portion of said forward stroke.

6. The automated handling system defined in claim 5, wherein each of said first and second extractors includes a pair of radially offset base rim engaging surfaces to accommodate ammunition modules of different base rim diameters.

7. The automated handling system defined in claim 5, wherein said first extractor includes a cam surface engaged by the ammunition module base rim as said forward stroke is concluded to deflect said first extractor into engaging relation with the module base rim.

8. The automated handling system defined in claim 1, wherein said extractor assembly is reciprocated through first forward and first reverse strokes, and wherein said tube is slidingly mounted by said base for axial reciprocation through second forward and second reverse strokes of axial lengths less than said first forward and first reverse stroke axial lengths, said carrier further including a stroke multiplier drive mechanism interconnecting said tube, base and extractor assembly to produce said first forward and reverse strokes of said extractor assembly in response to said second forward and reverse strokes of said tube.

9. The automated handling system defined in claim 8, wherein said stroke multiplier mechanism includes an actuator mounted by said base for propelling said tube through said second forward and reverse strokes, a network of pulleys mounted for axial motion in response to reciprocation of said tube, and a cable wrapped around said pulleys and having cable ends anchored to said base, said extractor assembly affixed to an axial run of said cable.

10. The automated handling system defined in claim 9, wherein said pulley network includes a first pulley mounted adjacent one end of said tube, a second pulley mounted adjacent the other end of said tube, and third and fourth pulleys, said cable running from one anchored end in a forward axial direction to said third pulley, around said third pulley to said first pulley in a reverse axial direction, around said first pulley along said axial cable run to said second pulley in said forward direction, around said second pulley to said fourth pulley in said reverse axial direction, and around said fourth pulley in said forward axial direction to another anchored end in said forward axial direction, and a gear network driven by said actuator and having a gear element mounting said third and fourth pulleys.

11. The automated handling system defined in claim 10, wherein said gear element is a first rack gear mounted for axial reciprocation by said base, said gear network further including a second rack gear affixed to said tube in an axial orientation and first and second drivingly interconnected pinion gears mounted by said base, said first pinion gear meshing with said first rack gear and said second pinion gear meshing with said second rack gear.

12. The automated handling system defined in claim 1, wherein said carrier further includes angularly spaced sets of axially distributed pads captured in axially extending tracks formed in the interior of said tube, said pads being spring radially inward to provide resilient, sliding support for ammunition modules of differing diameters while being propelled into and out of said tube by said extractor assembly.

13. The automated handling system defined in claim 12, wherein said carrier further includes wedging means selectively moveable into solid backing support for at least some of said pads to prevent shifting of the ammunition module centerline relative to the axis of said tube when the end-to-end orientation of said carrier is reversed incident to vertical motion between said upper and lower positions.

14. The automated handling system defined in claim 12, wherein the ammunition modules comprise projectiles and propellant units, and wherein said carrier further includes a stop mounted to said tube for radial movement into engagement with a projectile to sustain the axial position of the projectile in said tube while a propellant unit is driven into said tube from one of said first and second magazine to unite the projectile and propellant unit into a live ammunition round.

15. The ammunition handling system defined in claim 1, which further includes upper and lower trolleys between which are mounted vertical support columns slidingly mounting said carrier for vertical movement, said trolleys mounted for horizontal movement to translate said carrier between a stow location and an ammunition transfer location vertically aligned with said upper and lower positions.

16. The ammunition handling system defined in claim 15, which further includes means for propelling said upper trolley in horizontal motion and a pantographic cable and pulley arrangement interconnecting said upper and lower trolleys to force the horizontal motion of said lower trolley to precisely track the horizontal driven motion of said upper trolley.

17. An automated handling system for retrieving from and inserting into a storage magazine large caliber ammunition rounds for a cannon, said system comprising, in combination:

A. a carriage mounted for movement into a transfer position addressing a port of the storage magazine;

B. an ammunition carrier including 1) a base mounted to said carriage, and 2) an ammunition support mounted to said base for reciprocating motion through a first forward stroke and a first reverse stroke along a longitudinal path aligned with the magazine port while said carriage resides in said transfer position, said support including an elongated trackway oriented in parallel relation to said path;

C. an extractor assembly slidingly received in said trackway for reciprocating motion through a second forward stroke and a second reverse stroke of respective lengths greater than the lengths of said first forward and reverse strokes, said extractor assembly being structured to engage a radially protruding rim of an ammunition round to retract an ammunition round from the magazine out onto said support during said secured reverse stroke and to propel an ammunition round off said support into the magazine during said second forward stroke;

D. a stroke multiplier drive mechanism including 1) a motor carried by said base for propelling said support through said first forward and reverse strokes, and 2) a network of pulleys mounted for reciprocation parallel to said path in response to said first forward and reverse strokes of said support, 3) a cable wrapped around said pulleys in multiple overhaul fashion and having opposite ends anchored to said base, 4) said extractor assembly being clamped to a run of said cable extending parallel to said path.

18. The automated handling system defined in claim 17, wherein said pulley network includes a first pulley mounted adjacent one end of said support, a second pulley mounted adjacent the other end of said support, and third and fourth pulleys, said cable running from one anchored end in a forward direction parallel to said path to said third pulley, around said third pulley to said first pulley in a reverse direction parallel to said path, around said first pulley in said cable run to said second pulley in said forward direction, around said second pulley to said fourth pulley in said reverse direction, and around said fourth pulley in said forward direction to another anchored end, and a gear network driven by said motor and having a gear element mounting said third and fourth pulleys.

19. The automated handling system defined in claim 18, wherein said gear element is a first rack gear mounted for reciprocation parallel to said path by said base, said gear network further including a second rack gear affixed to said support in an orientation parallel to said path and first and second drivingly interconnected pinion gears mounted by said base, said first pinion gear meshing with said first rack gear and said second pinion gear meshing with said second rack gear.

20. The automated handling system defined in claim 18, wherein said carriage is mounted for vertical movement between upper and lower transfer positions respectively addressing ports of upper and lower magazines, and wherein said carrier base is mounted to said carriage for rotation in a vertical plane, said system further including means for jointly propelling said carriage in vertical movement and said carrier in rotational motion such that said carrier assumes one end-to-end orientation when said carriage is in said lower position and assumes a reversed end-to-end orientation when said carriage is in said upper position.

21. The automated handling system defined in claim 20, wherein said propelling means includes a vertically oriented ballscrew for driving said carriage in vertical movement and a rotating mechanism for driving said carrier in rotational motion, said rotating mechanism including a stationary rack gear fixed in parallel relation to said ballscrew, a first circular gear journalled by said carriage in position to be driven in rotation by said rack gear in response to vertical movement of said carriage, and a spur gear fixed to said base and driven off said circular gear to impart rotational motion to said carrier.

22. The automated handling system defined in claim 21, wherein said rack gear includes an upper toothed section and a lower non-toothed section, and said rotating mechanism further including a cam track mounted in fixed relation with said non-toothed section and a cam follower running in said cam track and fixed to said circular gear, said cam track being configured to maintain said carrier in a horizontal orientation during initial upward movement of said carriage from said lower position and then to impart rotational motion to said circular gear leading to synchronous meshing engagement with said toothed section of said rack gear.

23. The automated handling system defined in claim 18, wherein said extractor assembly includes first and second extractors jointly running in said trackway formed in said support and springs separately biasing said first and second extractors to transversely extended positions in said trackway, said first extractor in said extended position engaging the rim of an ammunition round during said second reverse stroke and said second extractor in said extended position engaging the rim of an ammunition round during said second forward stroke.

24. The automated handling system defined in claim 23, wherein said trackway includes a cam positioned to depress said first extractor to a transversely retracted position in non-engaging relation with the rim of an ammunition round during the concluding portion of said second forward stroke.

25. The automated handling system defined in claim 24, wherein each of said first and second extractors includes a pair of transversely offset rim engaging surfaces to accommodate ammunition rounds of different rim diameters.

26. The automated handling system defined in claim 25, wherein said first extractor includes a cam surface engaged by the rim of an ammunition round residing in one of the upper and lower magazine as said second forward stroke is concluded to deflect said first extractor into engaging relation with the rim thereof.

* * * * *